US009513588B2

(12) United States Patent
Furuyama

(10) Patent No.: US 9,513,588 B2
(45) Date of Patent: Dec. 6, 2016

(54) IMAGE FORMING APPARATUS FOR FORMING AN IMAGE ON A RECORDING MATERIAL

(71) Applicant: CANON KABUSHIKI KAISHA, Tokyo (JP)

(72) Inventor: Yoichi Furuyama, Nagoya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/800,561

(22) Filed: Jul. 15, 2015

(65) Prior Publication Data

US 2016/0018776 A1 Jan. 21, 2016

(30) Foreign Application Priority Data

Jul. 17, 2014 (JP) ..... 2014-147001

(51) Int. Cl.
*G03G 15/00* (2006.01)
*G03G 21/00* (2006.01)

(52) U.S. Cl.
CPC ..... *G03G 15/6529* (2013.01)

(58) Field of Classification Search
CPC .... G03G 15/00; G03G 15/6529; G03G 21/00; B65H 85/00; B65H 29/58; B41J 3/60
USPC ..... 399/401
See application file for complete search history.

(56) References Cited

U.S. PATENT DOCUMENTS 6,542,711 B2 * 4/2003 Matsunai ..... G03G 15/6573 399/322
2006/0239734 A1 * 10/2006 Ohtsuki ..... G03G 21/1685 399/401
2007/0009271 A1 * 1/2007 Tanonaka ..... G03G 15/657 399/45
2014/0062013 A1 * 3/2014 Nishimura ..... B65H 5/06 271/270

FOREIGN PATENT DOCUMENTS

JP 08091625 A * 4/1996 ..... G03G 15/00
JP 2000-109275 A 4/2000
JP 2003182902 A * 7/2003 ..... B65H 85/00

* cited by examiner

*Primary Examiner* — Nguyen Ha
(74) *Attorney, Agent, or Firm* — Canon U.S.A., Inc. IP Division

(57) ABSTRACT

An image forming apparatus includes a curved conveyance path being formed by an outer guide and an inner guide, and a control unit configured to control a first conveyance unit disposed on upstream of the conveyance path and a second conveyance unit disposed on downstream of the conveyance path such that a conveyance speed of the first conveyance unit is set greater than a conveyance speed of the second conveyance unit, in a case where an image surface of the recording material on which an image is formed faces the inner guide, and perform control of the first and the second conveyance units in such a manner that the conveyance speed of the first conveyance unit is set less than the conveyance speed of the second conveyance unit, in a case where the image surface of the recording material on which the image is formed faces the outer guide.

21 Claims, 4 Drawing Sheets

IMAGE FORMING APPARATUS FOR FORMING AN IMAGE ON A RECORDING MATERIAL

BACKGROUND OF THE INVENTION

Field of the Invention

The present invention relates to an image forming apparatus for forming an image on a recording material.

Description of the Related Art

In an image forming apparatuses, such as a multifunction peripheral, a printer and the like using an electrophotographic method, there is a problem in that scratches occur on an image surface of a sheet when the sheet rubs against a conveyance guide after passing through a fixing unit. Particularly in recent years, in the course of an increased demand for improvement in printing speed and miniaturization of image forming apparatus, a sheet conveyance speed becomes faster and it becomes necessary to reduce a curvature of a sheet conveyance path to design a space-saving product. In addition, there is an increased demand for improvement in quality of a printing outcome. Because of the above-described situation, scratches occurring on the image surface caused by the sheet rubbing against the conveyance guide have been increasingly treated as a major issue.

Japanese Patent Application Laid-Open No. 2000-109275 discusses a configuration in which a speed of a roller on a downstream in a conveyance direction is set to be faster than that of a roller on an upstream in a conveyance direction when a sheet is conveyed through a curved conveyance path while an image surface thereof is facing toward an outer guide. With this configuration, it is possible to prevent scratches occurring on the image surface of the sheet caused by the image surface of the sheet contacting the outer guide.

There is provided an image forming apparatus including an inversion mechanism employing a switchback system, capable of selecting between a face-down discharge in which a sheet is discharged with a surface on which an image is formed facing downward and a face-up discharge in which a sheet is discharged with a surface on which an image is formed facing upward. In the above image forming apparatus, orientation of a surface on which an image is formed is inversed when the sheet is discharged using the face-up discharge or the face-down discharge. Accordingly, in a case where a speed setting is fixed as in the configuration described in Japanese Patent Application Laid-Open No. 2000-109275, there is a risk in which an image surface may rub against a guide and scratches on the image surface may occur.

SUMMARY OF THE INVENTION

According to an aspect of the present invention, an image forming apparatus includes an image forming unit configured to form an image on a recording material, a curved conveyance path configured to allow the recording material on which the image is formed by the image forming unit to pass therethrough, the curved conveyance path being formed by an outer guide disposed outside a curvature and an inner guide disposed inside the curvature, a first conveyance unit configured to convey the recording material on an upstream of the conveyance path, a second conveyance unit configured to convey the recording material on a downstream of the conveyance path, and a control unit configured to perform control of the first and the second conveyance units in such a manner that a conveyance speed of the first conveyance unit is set greater than a conveyance speed of the second conveyance unit, in a case where an image surface of the recording material on which the image is formed faces the inner guide when the recording material passes through the conveyance path, and perform control of the first and the second conveyance units in such a manner that the conveyance speed of the first conveyance unit is set less than the conveyance speed of the second conveyance unit, in a case where the image surface of the recording material on which the image is formed faces the outer guide when the recording material passes through the conveyance path.

Further features of the present invention will become apparent from the following description of exemplary embodiments with reference to the attached drawings.

DESCRIPTION OF THE EMBODIMENTS

<Entire Configuration of Image Forming Apparatus>

Figure 1:
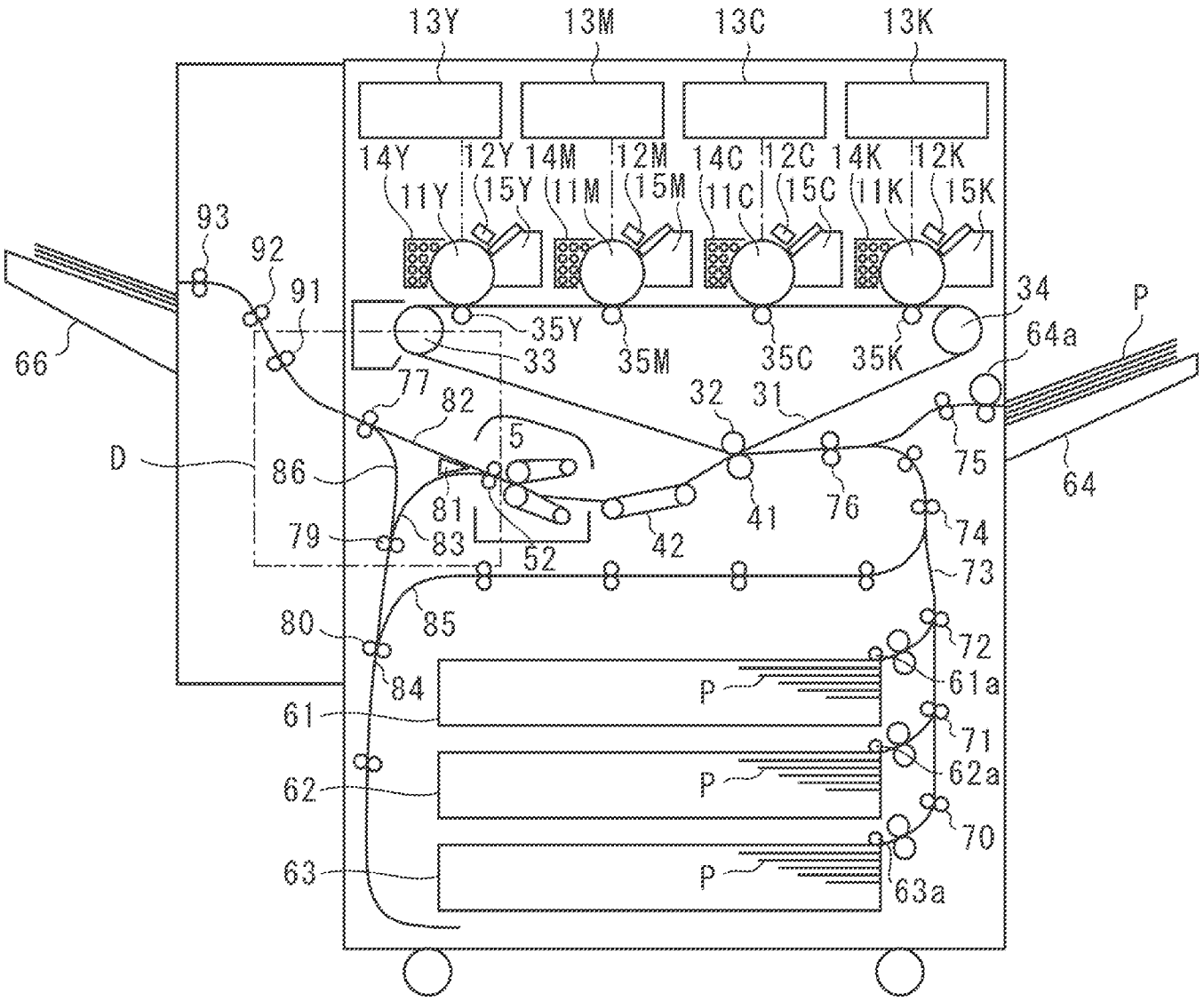
FIG. 1 is a schematic cross-sectional diagram illustrating an overall view of an image forming apparatus according to an exemplary embodiment of the present invention.

FIG. 1 is a schematic cross-sectional diagram illustrating an image forming apparatus as an example of an exemplary embodiment of the present invention. The image forming apparatus is a color image forming apparatus using an electrophotographic method.

A sheet P serving as a recording material is stacked and stored in sheet containers 61, 62, 63, and 64. The sheet P stored in the sheet container 61, 62, 63, or 64 is fed by a corresponding feeding unit 61*a*, 62*a*, 63*a*, or 64*a*. The sheet P fed through the feeding unit 61*a*, 62*a*, 63*a*, or 64*a* is conveyed to a registration roller pair 76 by any of a corresponding feeding roller(s) among feeding rollers 70, 71, 72, 73, 74, and 75. The registration roller pair 76 conveys the sheet P to a secondary transfer portion in a timing synchronizing with a toner image borne by an image-bearing member described below.

The secondary transfer portion is a transfer nip portion to the sheet P, the transfer nip portion being formed by a secondary transfer inner roller 32 and a secondary transfer outer roller 41 disposed opposite to each other. The secondary transfer portion applies a predetermined amount of pressure and electrostatic load bias to transfer the toner image onto the sheet P.

Processing for forming an image, which is executed in concurrent with the processing for conveying the sheet P to the secondary transfer portion, will be described.

Each image forming portion includes a photosensitive body 11 (11Y, 11M, 11C, and 11K), a charging device 12 (12Y, 12M, 12C, and 12K), and an exposure device (13Y, 13M, 13C, and 13K). Further, the image forming portion includes a development device 14 (14Y, 14M, 14C, and 14K), a primary transfer device 35 (35Y, 35M, 35C, and 35K), and a photosensitive body cleaner 15 (15Y, 15M, 15C, and 15K).

Based on a transmitted signal of image information, the exposure device 13 is driven to form an electrostatic latent image on the rotating photosensitive body 11. A surface of the photosensitive body 11 is uniformly charged by the charging unit 12 in advance.

The electrostatic latent image formed on the photosensitive body 11 is developed with toner by the development device 14 and visualized on the photosensitive body 11 as a toner image. Then, predetermined amounts of pressure and electrostatic load bias are applied to the toner image by the primary transfer device 35, so that the toner image is transferred onto an intermediate transfer belt 31. A transfer residual toner slightly left on the photosensitive body 11 is collected by the photosensitive body cleaner 15. Then, the image forming portion becomes ready for the subsequent image forming processing.

In the example illustrated in FIG. 1, four sets of the image forming portions are provided for respective colors of yellow (Y), magenta (M), cyan (C) and black (Bk). The number of colors is not limited to four colors, and an arrangement order of the colors is not limited to the above.

The intermediate transfer belt 31 will be described. The intermediate transfer belt 31 is stretched on a plurality of rollers, such as a driving roller 33, a tension roller 34, and the secondary transfer inner roller 32, and is conveyed and driven thereby. The image forming processing of respective colors, concurrently processed by the above-described image forming portions for respective colors of Y, M, C, and Bk, is executed at the timing at which each of the toner images is overlapped with the toner image of the upstream color that is primarily transferred onto the intermediate transfer belt 31. As a result, a full-color toner image is eventually formed on the intermediate transfer belt 31 and conveyed to the secondary transfer portion.

Through the above-described conveyance processing and the image forming processing executed on the sheet P, a full-color toner image is secondarily transferred onto the sheet P at the secondary transfer portion. Then, the sheet P is conveyed to a fixing unit 5 serving as a fixing portion by a suction conveyance unit 42. The suction conveyance unit 42 conveys the sheet P by using a fan and the like while sucking the sheet P with air.

The fixing unit 5, which constitutes an image forming unit together with the image forming portions and the intermediate transfer belt 31, applies a predetermined amount of pressure from a counter roller, a belt, or the like and a heating effect from a heat source to the toner image to melt and fix the toner image onto the sheet P. The sheet P on which the image is fixed is conveyed to a discharge tray 66 serving as a sheet discharge-stacking portion through a discharge unit D.

The sheet P on which an image is formed on one side is discharged to the exterior by a straight sheet discharge or an inversed sheet discharge.

The sheet P that is to be discharged by the straight sheet discharge is guided to a straight path 82, conveyed by a junction conveyance roller 77, a conveyance roller 91, and discharge rollers 92 and 93, and discharged to the discharge tray 66.

The sheet P discharged by the straight sheet discharge is discharged to the discharge tray 66 in a face-up state where the image surface faces upward. The straight sheet discharge is set in a case where only one sheet P is discharged, or in a case where a plurality of sheets P on which the same images are formed is consecutively discharged. In the straight sheet discharge, a switching member 81 which is moved by a solenoid (not illustrated) is placed on a position for guiding the sheet P to the straight path 82, so that the sheet P conveyed from the fixing unit 5 is guided to the straight path 82.

The sheet P discharged by the inversed sheet discharge is guided to an inversion path 83. Then, the sheet P is pulled into a switchback path 84 from the inversion path 83 by an inversion roller pair 79. Then, a rotational direction of the inversion roller pair 79 serving as a switchback conveyance unit is reversed (switched back) from the forward direction to the backward direction, so that the sheet P is guided to a post-inversion path 86. The sheet P guided upward through the post-inversion path 86 is conveyed by the junction conveyance roller 77, the conveyance roller 91, and the discharge rollers 92 and 93, and discharged onto the discharge tray 66. The sheet P switched back by the inversion roller pair 79 is guided to the junction conveyance roller 77 while the front and the back surfaces are inversed.

The sheet P discharged by the inversed sheet discharge is discharged to the discharge tray 66 in a face-down state where the image surface faces downward. The inversed sheet discharge is set in a case where a plurality of sheets P in a sequential page order is consecutively discharged. In the inversed sheet discharge, the switching member 81 is placed on a position for guiding the sheet P to the inversion path 83, so that the sheet P conveyed from the fixing unit 5 is guided to the inversion path 83.

A conveyance operation of the sheet P for forming images on both sides of the sheet P will be described.

The sheet P on which an image has been formed on one side (first surface) is guided to the inversion path 83. After the sheet P is pulled into the switchback path 84 from the inversion path 83, the rotational direction of two-sided inversion rollers 80 is reversed from the forward direction to the backward direction, so that the sheet P is guided to a two-sided conveyance path 85. The sheet P passes through the two-sided conveyance path 85 to be conveyed to the registration roller pair 76. Then, similar to the operation for forming an image on the first surface, the sheet P is conveyed to the secondary transfer portion through the registration roller pair 76, so that an image is formed on a second surface of the sheet P.

The sheet P on which the images are formed on the two sides, which is conveyed from the fixing unit 5, is guided to the straight path 82. Then, the sheet P is conveyed by the junction conveyance roller 77, the conveyance roller 91, and the discharge rollers 92 and 93, and discharged to the discharge tray 66. The sheet P on which the images are formed on the two sides is discharged to the exterior in a state where the first surface on which the image is firstly formed faces downward.

<Configuration and Control Processing of Discharge Unit D>

Figure 2B:
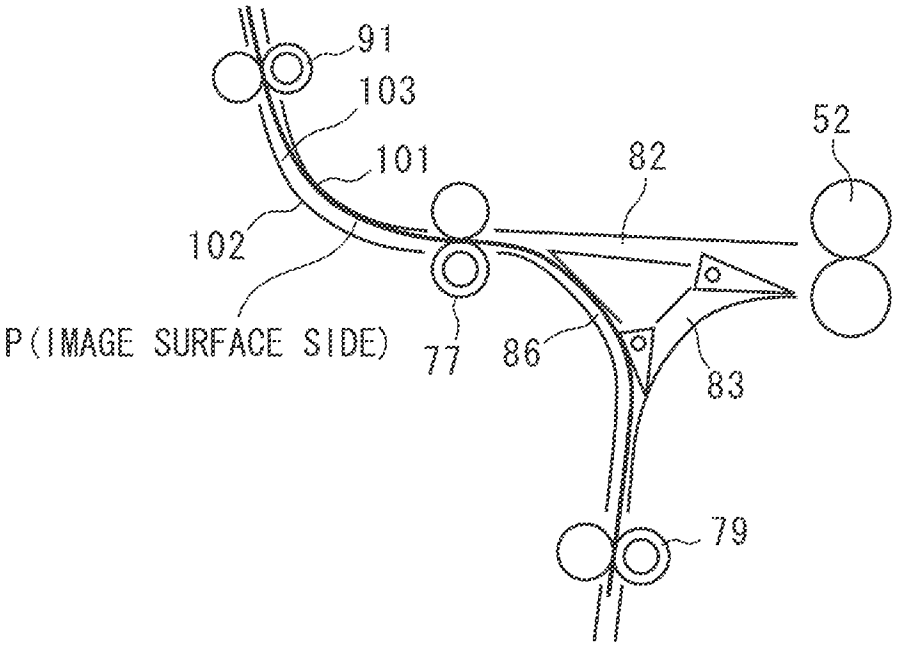
FIGS. 2A and 2B are schematic cross-sectional diagrams each illustrating a discharge unit of the image forming apparatus according to an exemplary embodiment of the present invention.
Figure 2A:
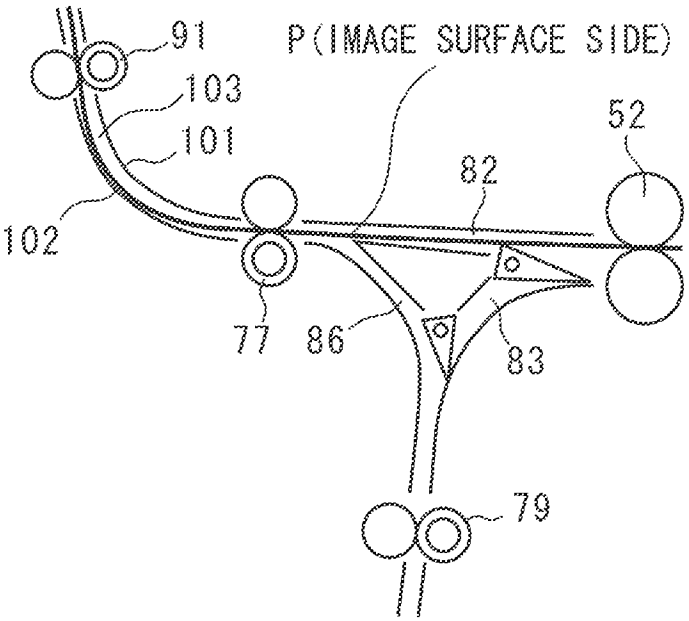

FIGS. 2A and 2B are diagrams each illustrating an enlarged cross-sectional view of a discharge unit D provided on the image forming apparatus. A curved (bent) conveyance path 103 is disposed on a position between the junction conveyance roller 77 and the conveyance roller 91. The junction conveyance roller 77 is a roller where the sheet P passes through in both processing of the straight sheet discharge and the inversion discharge, and the conveyance roller 91 is disposed on the downstream of the junction conveyance roller 77. The curved conveyance path 103 is formed by an inner guide 101 and an outer guide 102 formed of metal. The inner guide 101 is disposed inside the curvature of the curved conveyance path 103, whereas the outer guide 102 is disposed outside the curvature of the curved conveyance path 103. In other words, a guide close to the center of the curvature of a curved line along the curved conveyance path 103 is the inner guide 101, whereas a guide away from the center of the curvature is the outer guide 102. Each of the junction conveyance roller 77 and the conveyance roller 91 is driven by an individual driving motor, i.e., an upstream driving motor M1 and a downstream driving motor M2 illustrated in FIG. 4.

In the above-described curved conveyance path, there is a risk in which the sheet P after the fixing operation may rub against the guide and scratches may occur on the image surface of the sheet P. In particular, in a case where the conveyance guide is configured of a bend sheet metal, the sheet P may strongly rub against a bend portion of the bend sheet metal, and thus scratches are likely to occur on the image surface of the sheet P. In addition, scratches are more likely to be visible when the sheet P is a coated sheet or when a toner density of the image is high.

Figure 3:
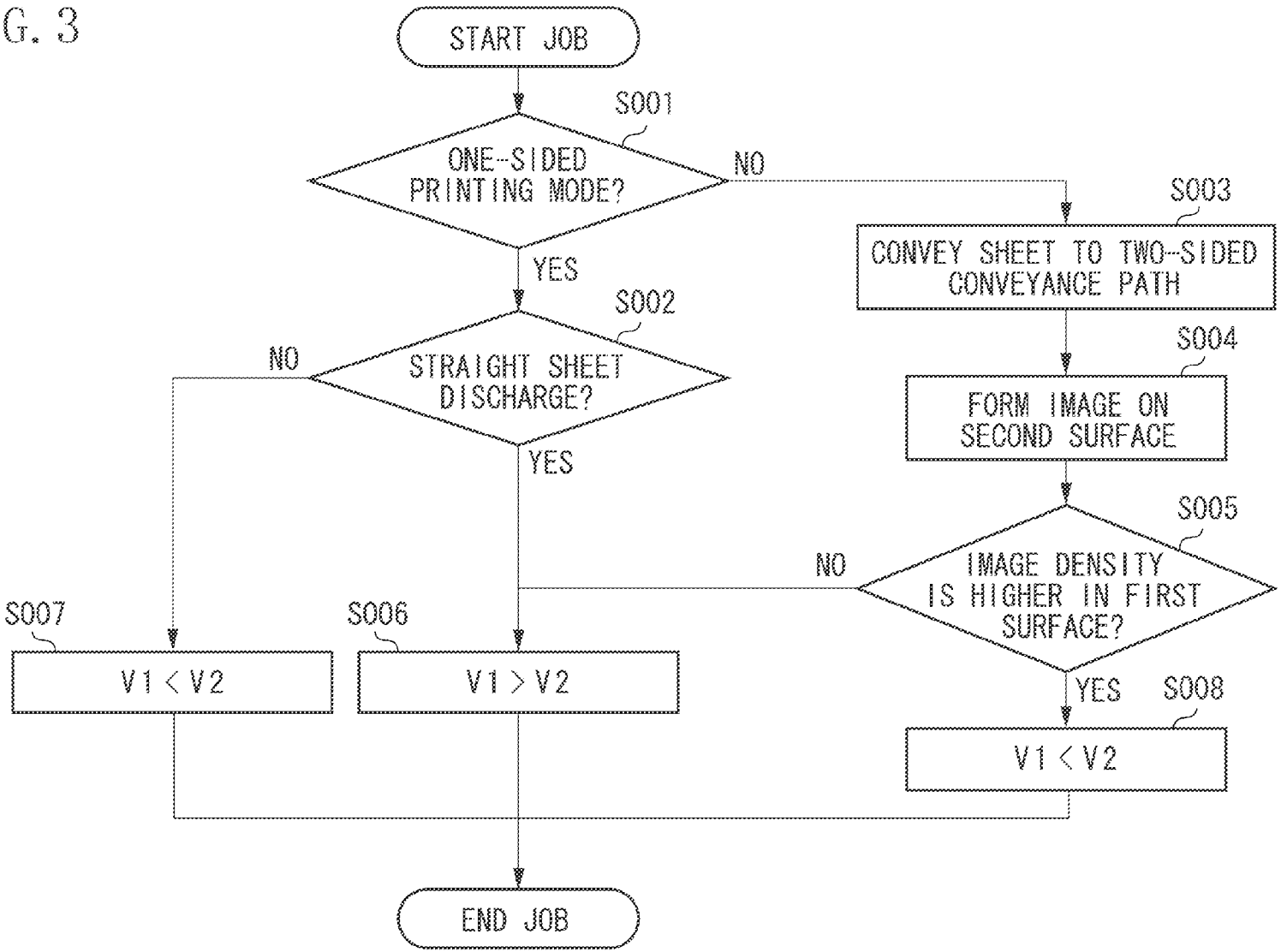
FIG. 3 is a flowchart illustrating an operation executed by the image forming apparatus according to an exemplary embodiment of the present invention.

In order to prevent the scratches on the image caused by the sheet P rubbing against the inner guide 101 or the outer guide 102 disposed on the downstream of the fixing unit 5, according to the present exemplary embodiment, processing for controlling the speeds of the junction conveyance roller 77 and the conveyance roller 91 is executed as described below. Speed control of respective junction conveyance roller 77 and conveyance roller 91 performed in each processing of the straight sheet discharge, the inversed sheet discharge, and the two-sided image forming will be described with reference to the flowchart in FIG. 3 and the block diagram in FIG. 4.

Figure 4:
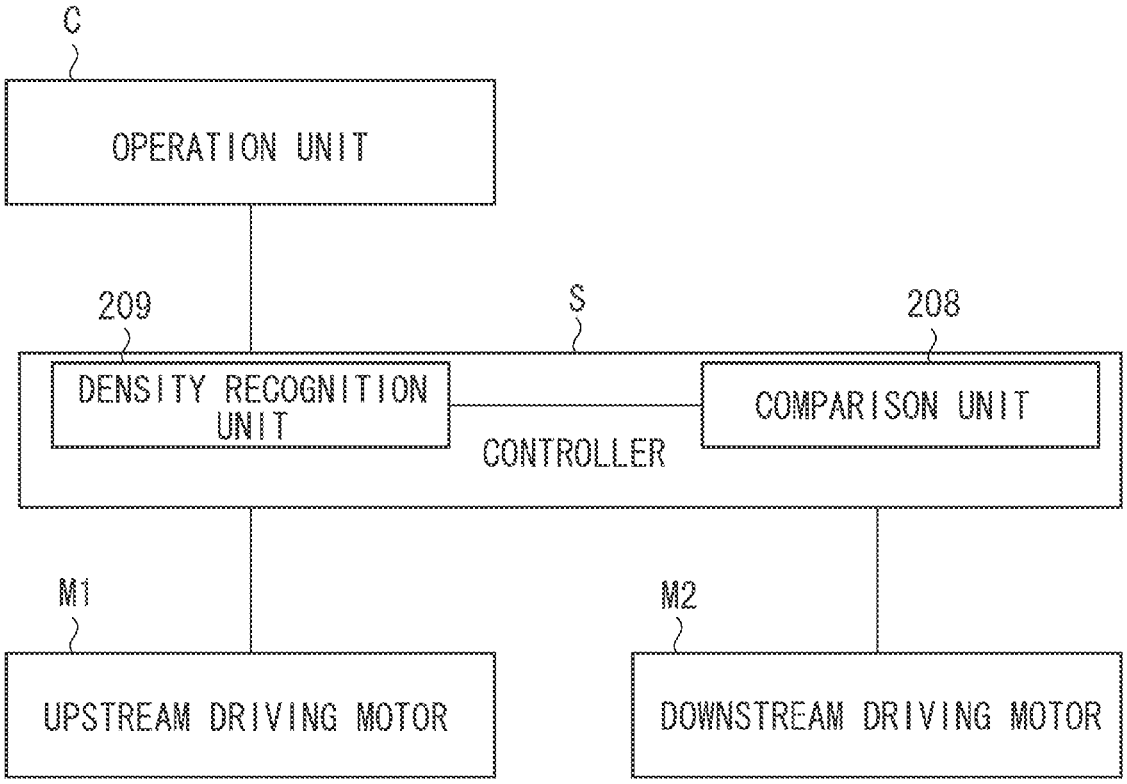
FIG. 4 is a diagram illustrating a control block of the image forming apparatus according to an exemplary embodiment of the present invention.

As illustrated in the block diagram in FIG. 4, a controller S serving as a control unit disposed on the image forming apparatus is connected to an operation unit C serving as an operation panel. Based on the information set through the operation unit C functioning as a setting unit, the controller S executes driving control of the upstream driving motor M1 for driving the junction conveyance roller 77 and the downstream driving motor M2 for driving the conveyance roller 91. A first conveyance unit for conveying the sheet P is configured of the junction conveyance roller 77 and the upstream driving motor M1 that drives the junction conveyance roller 77. A second conveyance unit for conveying the sheet P is configured of the conveyance roller 91 and the downstream driving motor M2 that drives the conveyance roller 91.

Further, the controller S includes a density recognition unit 209 for recognizing a density of the toner image formed on the sheet P. According to the present exemplary embodiment, the density recognition unit 209 recognizes the density based on a video count value. The controller S includes a comparison unit 208 that performs a comparison between the toner densities of the first and the second surfaces based on a recognition result of the density recognition unit 209 for the higher toner density from among the toner densities of the images formed on the first and the second surfaces of the sheet P in a case where the images are formed on both sides.

When the user operates the operation unit C to transmit a print job to the controller S, in step S001, the controller S determines whether the print job is a job which is processed by one-sided image formation using the straight sheet discharge. In a case where the controller S determines that the print job is the job processed by the one-sided image formation (YES in step S001), the processing proceeds to step S002. In step S002, the controller S determines whether the print job is a job processed using the straight sheet discharge. For example, in a case where a setting for executing an operation for discharging only one sheet P or a setting for executing an operation for consecutively discharging a plurality of sheets P having the same images is set through the operation unit C, the controller S determines that the print job is the job processed using the straight sheet discharge (YES in step S002), so that the processing proceeds to step S006. In a case where a setting for executing an operation for consecutively discharging a plurality of sheets P in a sequential page order is set through the operation unit C, the controller S determines that the print job is a job processed using the inversed sheet discharge (NO in step S002), so that the processing proceeds to step S007.

FIG. 2A is a diagram illustrating a conveyance state of the sheet P in the process of the straight sheet discharge. As illustrated in FIG. 2A, when the sheet P passes through the curved conveyance path 103 configured of the inner guide 101 and the outer guide 102, one surface of the sheet P on which an image is formed (hereinafter, referred to as an "image surface") faces the inner guide 101. Thus, in step S006, in order to prevent the image surface from rubbing against the inner guide 101, the controller S controls the upstream driving motor M1 and the downstream driving motor M2 to set a sheet conveyance speed V1 of the junction conveyance roller 77 to be greater than a sheet conveyance speed V2 of the conveyance roller 91. Through the above processing, the sheet P is conveyed while a warp of the sheet P expanding toward the outer guide 102 increases gradually. Therefore, the sheet P is conveyed while another surface on which an image is not formed (non-image surface) makes contact with the outer guide 102 (i.e., while the non-image surface is guided by the outer guide 102). In other words, the sheet P is conveyed while the image surface thereof is separated from the inner guide 101. Accordingly, the sheet P is less likely to have scratches on the image surface.

Description will be given to the processing that is to be executed when a determination result in step S002 is "NO", i.e., when the sheet P on which the image is formed on one side is discharged using the inversed sheet discharge.

FIG. 2B is a diagram illustrating a conveyance state of the sheet P in the process of the inversed sheet discharge. As illustrated in FIG. 2B, when the sheet P passes through the curved conveyance path 103 configured of the inner guide 101 and the outer guide 102, the image surface of the sheet P faces the outer guide 102. Thus, in step S007, in order to prevent the image surface from rubbing against the outer guide 102, the controller S controls the upstream driving motor M1 and the downstream driving motor M2 to set the sheet conveyance speed V1 of the junction conveyance roller 77 to be less than the sheet conveyance speed V2 of the conveyance roller 91. Through the above processing, the sheet P is conveyed while being pulled and stretched between the junction conveyance roller 77 and the conveyance roller 91, so that the warp of the sheet P expanding toward the outer guide 102 is being reduced. Therefore, the sheet P is conveyed while making contact with the inner guide 101 (i.e., while being guided by the inner guide 101). In other words, the sheet P is conveyed while the image surface thereof is separated from the outer guide 102. Accordingly, the sheet P is less likely to have scratches on the image surface.

Description will be given to the processing for controlling the speeds of the junction conveyance roller 77 and the conveyance roller 91 in the two-sided printing mode in which images are formed on both sides of the sheet P. In a case where the controller S determines that the print job is processed in the two-sided printing mode (NO in step S001), the processing proceeds to step S003. In step S003, the sheet P on which an image has been formed on one side is conveyed to the two-sided conveyance path 85. Then, in step S004, another image is formed on the second surface of the sheet P. As described above, after another image is formed on the second surface, the sheet P passes through the straight path 82, and is then conveyed by the junction conveyance roller 77, the conveyance roller 91, and the discharge rollers 92 and 93.

Visibility of the scratches occurring on an image caused by the sheet P rubbing against the guide will be increased in a case where a toner application amount is larger, or an image density is higher. In other words, the scratches on an image are more likely to be visible when the image with high density is formed. Therefore, in a case where the image forming processing is executed on both sides of the sheet P, the densities (i.e., toner application amounts) of the images formed on the first and the second surfaces are previously recognized by the density recognition unit 209, so that the controller S executes control for preventing the image surface having the higher density from rubbing against the inner guide 101 or the outer guide 102.

In step S005, in a case where the controller S determines by using the comparison unit 208 that the density of the image formed on the first surface of the sheet P is higher than that of the second surface (YES in step S005), the processing proceeds to step S008. Then, the controller S executes the following control processing. In step S008, in order to prevent the first surface of the sheet P from rubbing against the outer guide 102, the controller S sets the sheet conveyance speed V1 of the junction conveyance roller 77 to be less than the sheet conveyance speed V2 of the conveyance roller 91.

In a case where the controller S determines by using the comparison unit 208 that the density of the image formed on the second surface of the sheet P is higher than that of the first surface (NO in step S005), the processing proceeds to step S006. Then, the controller S executes the following control processing. In step S006, in order to prevent the second surface of the sheet P from rubbing against the inner guide 101, the controller S sets the sheet conveyance speed V1 of the junction conveyance roller 77 to be greater than the sheet conveyance speed V2 of the conveyance roller 91. The sheet P is conveyed in a state where the sheet conveyance speed V1 of the junction conveyance roller 77 is set to be greater than the sheet conveyance speed V2 of the conveyance rollers 91.

If there is an excessive difference between the speeds of the junction conveyance roller 77 and the conveyance roller 91, the sheet P may be strained or buckled, and a damage, such as a wrinkle or a bend, may occur in the sheet P, or a load may be applied to the driving system. Therefore, the speed difference has to be set appropriately.

According to the present exemplary embodiment, a processing speed of the image forming apparatus (i.e., conveyance speed of the sheet P at the secondary transfer portion) is set to 300 mm/s. Further, the conveyance speed of the fixing unit 5 and the sheet conveyance speed V1 of the junction conveyance roller 77 are also set to 300 mm/s. According to the present exemplary embodiment, both of the inner guide 101 and the outer guide 102 are formed of sheet metals, and bend portions of the inner guide 101 and the outer guide 102 have the curvature of R70. Furthermore, a distance between the inner guide 101 and the outer guide 102 is 3 mm.

In order to prevent a buckle or a wrinkle occurring from a difference in speeds of the junction conveyance roller 77 and the conveyance roller 91, a warp amount and the pulling amount of the sheet P positioned between the junction conveyance roller 77 and the conveyance roller 91 are set to be 3 mm at a maximum. In other words, when the sheet P has a maximum size (i.e., according to the present exemplary embodiment, an A3-size) that can be processed by the image forming apparatus, the sheet conveyance speed V2 is determined in such a manner that the pushing amount of the junction conveyance roller 77 against the conveyance roller 91 and the pulling amount of the conveyance roller 91 against the junction conveyance roller 77 are set to be 3 mm.

More specifically, in order to set the sheet conveyance speed V1 to be greater than the sheet conveyance speed V2 (V1>V2) for the straight sheet discharge, the sheet conveyance speed V2 can be acquired by the following formula:

$$V2=((420-3)\ \text{mm}\times 300\ \text{mm/s})/420\ \text{mm}=297.9\ \text{mm/s}.$$

In order to set the sheet conveyance speed V1 to be less than the sheet conveyance speed V2 (V1<V2) for the inversed sheet discharge, the sheet conveyance speed V2 can be acquired by the following formula:

$$V2=((420+3)\ \text{mm}\times 300\ \text{mm/s})/420\ \text{mm}=302.1\ \text{mm/s}.$$

By setting the sheet conveyance speed V2 as described above, the image surface does not rub against the guide during the sheet conveyance period, and thus a negative effect of difference in speeds of the rollers can be prevented.

In the present exemplary embodiment, an example for setting the speed is described. However, an appropriate speed difference may vary depending on a curvature of the bent conveyance path or a configuration (e.g., material) of the guide. Therefore, the appropriate value may be confirmed and determined experimentally according to a shape and a configuration of the conveyance path.

A setting of the sheet conveyance speed may be changed according to a type of the sheet P (i.e., sheet type). In particular, scratches on an image are more likely to be visible in a coated sheet having a glossy surface or a sheet having a large grammage. On the contrary, in a non-coated sheet or a sheet having a small grammage, scratches on an image are less likely to be visible although wrinkles caused by a difference in speeds of the rollers are more likely to occur.

Therefore, in a case where an image is formed on a coated sheet having a glossy surface, the difference in speeds of the junction conveyance roller 77 and the conveyance roller 91 is set to be greater in comparison to the case of a non-coated sheet. Further, in a case where an image is formed on a sheet having a grammage larger than a predetermined amount, the difference in speeds of the junction conveyance roller 77 and the conveyance roller 91 is set to be greater in comparison to the case of a sheet having a grammage smaller than a predetermined amount. The above-described variation of the exemplary embodiment will be described illustratively with reference to the flowchart in FIG. 3. In a case where the sheet P is a coated sheet or a sheet having a grammage larger than a predetermined amount, in steps S007 and S008, the sheet conveyance speed V2 is set to 303 mm/s that is the speed greater than the sheet conveyance speed V2 (i.e., 302.1 mm/s) for the non-coated sheet or the sheet having a grammage smaller than a predetermined amount. In a case where the sheet P is a coated sheet or a sheet having a grammage larger than a predetermined amount, in step S006, the sheet conveyance speed V2 is set to 297 mm/s that is the speed less than the sheet conveyance speed V2 (i.e., 297.9 mm/s) for the non-coated sheet or the sheet having a grammage smaller than a predetermined amount. As described above, by changing the speed difference according to the sheet type, scratches and wrinkles occurring on the image can be prevented in various media.

As described above, according to the present exemplary embodiment, the speeds of the upstream and the downstream rollers disposed on the bent conveyance path positioned after the fixing unit are controlled according to the straight sheet discharge or the inversed sheet discharge when the image is formed on one side, whereas the speeds of the upstream and the downstream rollers are controlled according to the image densities of the first and the second surfaces when the images are formed on the two sides. With the above-described speed control processing, it is possible to prevent the scratches occurring on an image caused by a sheet rubbing against a guide.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-147001, filed Jul. 17, 2014, which is hereby incorporated by reference herein in its entirety.

What is claimed is:

1. An image forming apparatus comprising:

an image forming unit configured to form an image on a recording material;

a curved conveyance path configured to allow the recording material on which the image is formed by the image forming unit to pass therethrough, the curved conveyance path being formed by an outer guide disposed outside a curvature and an inner guide disposed inside the curvature;

a first conveyance unit configured to convey the recording material on an upstream of the conveyance path;

a second conveyance unit configured to convey the recording material on a downstream of the conveyance path;

a setting unit configured to set information relating to whether an image surface of the recording material on which the image is formed faces the inner guide or the outer guide when the recording material passes through the conveyance path; and a control unit configured to control the first and the second conveyance units to change a conveyance speed of the first conveyance unit to be less or greater than a conveyance speed of the second conveyance unit, based on the information set by the setting unit.

2. The image forming apparatus according to claim 1, wherein, when the recording material on which images are formed on two sides passes through the conveyance path, the control unit performs control of the first and the second conveyance units in such a manner that the conveyance speed of the first conveyance unit is set greater than the conveyance speed of the second conveyance unit, in a case where the image surface having a higher density among a first surface and a second surface of the recording material faces the inner guide, and performs control of the first and the second conveyance units in such a manner that the conveyance speed of the first conveyance unit is set less than the conveyance speed of the second conveyance unit, in a case where the image surface having a higher density among the first surface and the second surface of the recording material faces the outer guide.

3. The image forming apparatus according to claim 1, wherein a difference between the conveyance speed of the first conveyance unit and the conveyance speed of the second conveyance unit is changed according to a type of the recording material.

4. The image forming apparatus according to claim 1, wherein, in a case where the recording material is a coated sheet, the control unit controls a difference between the conveyance speed of the first conveyance unit and the conveyance speed of the second conveyance unit to be greater than a difference of those in a case of a non-coated sheet.

5. The image forming apparatus according to claim 1, wherein, in a case where the recording material has a grammage equal to or larger than a predetermined amount, the control unit controls a difference between the conveyance speed of the first conveyance unit and the conveyance speed of the second conveyance unit to be greater than a difference of those in a case of a grammage smaller than a predetermined amount.

6. The image forming apparatus according to claim 1, wherein the image forming unit includes a transfer unit configured to transfer a toner image on the recording material and a fixing unit configured to fix the toner image transferred by the transfer unit on the recording material;

wherein the recording material on which the toner image is fixed by the fixing unit passes through the conveyance path.

7. The image forming apparatus according to claim 1 comprising, a switchback conveyance unit configured to switch back the recording material on which the image is formed by the image forming unit in such manner that a front and a back surface of the recording material is inverted, and convey the recording material to the conveyance path inverting.

8. An image forming apparatus comprising:

a transfer unit configured to transfer an image on the recording material;

a fixing unit configured to fix the image transferred by the transfer unit on the recording material;

a first conveyance unit provided on a downstream of the fixing unit in a conveying direction and configured to convey the recording material on which the image has been fixed by the fixing unit;

a second conveyance unit provided on a downstream of the first conveyance unit and configured to convey the recording material;

a switchback conveyance unit configured to switch back the recording material on which the image has been fixed by the fixing unit in such a manner that a front and a back surface of the recording material is inverted, the switchback conveyance unit being disposed between the fixing unit and the first conveyance unit;

a conveyance path through which the recording material on which the image has been fixed by the fixing unit passes, the conveyance path comprising a curved portion disposed between the first conveyance unit and the second conveyance unit, the curved portion being formed by an outer guide disposed outside a curvature and an inner guide disposed inside the curvature; and a control unit configured to switchably perform a first operation and a second operation based on whether the recording material passed through the curved portion is switched back by the switchback conveyance unit or not, wherein a conveyance speed of the first conveyance unit is set greater than a conveyance speed of the second conveyance unit in the first operation, and the conveyance speed of the first conveyance unit is set less than the conveyance speed of the second conveyance unit in the second operation.

9. The image forming apparatus according to claim 8, wherein in a case that the recording material is switched back by the switchback conveyance unit, an image surface of the recording material on which the image is transferred faces the outer guide of the curved portion and the control unit performs the second operation, and in a case that the recording material is not switched back by the switchback conveyance unit, the image surface of the recording material on which the image is transferred faces the inner guide of the curved portion and the control unit performs the first operation.

10. The image forming apparatus according to claim 8, wherein, when a recording material on which images are transferred on two sides passes through the conveyance path, the control unit performs control of the first and the second conveyance units in such a manner that a conveyance speed of the first conveyance unit is set greater than a conveyance speed of the second conveyance unit, in a case where an image surface having a higher density among a first surface and a second surface of the recording material faces the inner guide, and performs controls of the first and the second conveyance units in such a manner that the conveyance speed of the first conveyance unit is set less than the conveyance speed of the second conveyance unit, in a case where the image surface having the higher density among the first surface and the second surface of the recording material faces the outer guide.

11. The image forming apparatus according to claim 8, wherein a difference between the conveyance speed of the first conveyance unit and the conveyance speed of the second conveyance unit is changed according to a type of the recording material.

12. The image forming apparatus according to claim 8, wherein, in a case where the recording material is a coated sheet, the control unit controls a difference between the conveyance speed of the first conveyance unit and the conveyance speed of the second conveyance unit to be greater than a difference of those in a case of a non-coated sheet.

13. The image forming apparatus according to claim 8, wherein, in a case where the recording material has a grammage equal to or larger than a predetermined amount, the control unit controls a difference between the conveyance speed of the first conveyance unit and the conveyance speed of the second conveyance unit to be greater than a difference of those in a case of a grammage smaller than a predetermined amount.

14. An image forming apparatus comprising:

a transfer unit configured to transfer an image on the recording material;

a fixing unit configured to fix the image transferred by the transfer unit on the recording material;

a first conveyance unit provided on a downstream of the fixing unit in a conveying direction and configured to convey the recording material on which the image has been fixed by the fixing unit;

a second conveyance unit provided on a downstream of the first conveyance unit and configured to convey the recording material;

a conveyance path through which the recording material on which the image has been fixed by the fixing unit passes, the conveyance path comprising a curved portion disposed between the first conveyance unit and the second conveyance unit, the curved portion being formed by an outer guide disposed outside a curvature and an inner guide disposed inside the curvature; and a control unit configured to perform control of the first and the second conveyance units in such a manner that a conveyance speed of the first conveyance unit is set greater than a conveyance speed of the second conveyance unit, in a case where an image surface of the recording material on which the image is transferred faces the inner guide when the recording material passes through the curved portion of the conveyance path, and perform control of the first and the second conveyance units in such a manner that the conveyance speed of the first conveyance unit is set less than the conveyance speed of the second conveyance unit, in a case where the image surface of the recording material on which the image is transferred faces the outer guide when the recording material passes through the curved portion of the conveyance path, wherein, when a recording material on which images are transferred on two sides passes through the conveyance path, the control unit performs control of the first and the second conveyance units in such a manner that a conveyance speed of the first conveyance unit is set greater than a conveyance speed of the second conveyance unit, in a case where an image surface having a higher density among a first surface and a second surface of the recording material faces the inner guide, and performs controls of the first and the second conveyance units in such a manner that the conveyance speed of the first conveyance unit is set less than the conveyance speed of the second conveyance unit, in a case where the image surface having the higher density among the first surface and the second surface of the recording material faces the outer guide.

15. The image forming apparatus according to claim 14, comprising, a switchback conveyance unit configured to switch back the recording material on which the image is fixed by the fixing unit in such a manner that a front and a back surface of the recording material is inverted, and convey the recording material to the first conveyance unit.

16. An image forming apparatus comprising:

a transfer unit configured to transfer an image on the recording material;

a fixing unit configured to fix the image transferred by the transfer unit on the recording material;

a first conveyance unit provided on a downstream of the fixing unit in a conveying direction and configured to convey the recording material on which the image has been fixed by the fixing unit;

a second conveyance unit provided on a downstream of the first conveyance unit and configured to convey the recording material;

a conveyance path through which the recording material on which the image has been fixed by the fixing unit passes, the conveyance path comprising a curved portion disposed between the first conveyance unit and the second conveyance unit, the curved portion being formed by an outer guide disposed outside a curvature and an inner guide disposed inside the curvature; and a control unit configured to perform control of the first and the second conveyance units in such a manner that a conveyance speed of the first conveyance unit is set greater than a conveyance speed of the second conveyance unit, in a case where an image surface of the recording material on which the image is transferred faces the inner guide when the recording material passes through the curved portion of the conveyance path, and perform control of the first and the second conveyance units in such a manner that the conveyance speed of the first conveyance unit is set less than the conveyance speed of the second conveyance unit, in a case where the image surface of the recording material on which the image is transferred faces the outer guide when the recording material passes through the curved portion of the conveyance path, wherein a difference between the conveyance speed of the first conveyance unit and the conveyance speed of the second conveyance unit is changed according to a type of the recording material.

17. The image forming apparatus according to claim 16, comprising, a switchback conveyance unit configured to switch back the recording material on which the image is fixed by the fixing unit in such a manner that a front and a back surface of the recording material is inverted, and convey the recording material to the first conveyance unit.

18. An image forming apparatus comprising:

a transfer unit configured to transfer an image on the recording material;

a fixing unit configured to fix the image transferred by the transfer unit on the recording material;

a first conveyance unit provided on a downstream of the fixing unit in a conveying direction and configured to convey the recording material on which the image has been fixed by the fixing unit;

a second conveyance unit provided on a downstream of the first conveyance unit and configured to convey the recording material;

a conveyance path through which the recording material on which the image has been fixed by the fixing unit passes, the conveyance path comprising a curved portion disposed between the first conveyance unit and the second conveyance unit, the curved portion being formed by an outer guide disposed outside a curvature and an inner guide disposed inside the curvature; and a control unit configured to perform control of the first and the second conveyance units in such a manner that a conveyance speed of the first conveyance unit is set greater than a conveyance speed of the second conveyance unit, in a case where an image surface of the recording material on which the image is transferred faces the inner guide when the recording material passes through the curved portion of the conveyance path, and perform control of the first and the second conveyance units in such a manner that the conveyance speed of the first conveyance unit is set less than the conveyance speed of the second conveyance unit, in a case where the image surface of the recording material on which the image is transferred faces the outer guide when the recording material passes through the curved portion of the conveyance path, wherein, in a case where the recording material is a coated sheet, the control unit controls a difference between the conveyance speed of the first conveyance unit and the conveyance speed of the second conveyance unit to be greater than a difference of those in a case of a non-coated sheet.

19. The image forming apparatus according to claim 18, comprising, a switchback conveyance unit configured to switch back the recording material on which the image is fixed by the fixing unit in such a manner that a front and a back surface of the recording material is inverted, and convey the recording material to the first conveyance unit.

20. An image forming apparatus comprising:

a transfer unit configured to transfer an image on the recording material;

a fixing unit configured to fix the image transferred by the transfer unit on the recording material;

a first conveyance unit provided on a downstream of the fixing unit in a conveying direction and configured to convey the recording material on which the image has been fixed by the fixing unit;

a second conveyance unit provided on a downstream of the first conveyance unit and configured to convey the recording material;

a conveyance path through which the recording material on which the image has been fixed by the fixing unit passes, the conveyance path comprising a curved portion disposed between the first conveyance unit and the second conveyance unit, the curved portion being formed by an outer guide disposed outside a curvature and an inner guide disposed inside the curvature; and a control unit configured to perform control of the first and the second conveyance units in such a manner that a conveyance speed of the first conveyance unit is set greater than a conveyance speed of the second conveyance unit, in a case where an image surface of the recording material on which the image is transferred faces the inner guide when the recording material passes through the curved portion of the conveyance path, and perform control of the first and the second conveyance units in such a manner that the conveyance speed of the first conveyance unit is set less than the conveyance speed of the second conveyance unit, in a case where the image surface of the recording material on which the image is transferred faces the outer guide when the recording material passes through the curved portion of the conveyance path, wherein, in a case where the recording material has a grammage equal to or larger than a predetermined amount, the control unit controls a difference between the conveyance speed of the first conveyance unit and the conveyance speed of the second conveyance unit to be greater than a difference of those in a case of a grammage smaller than a predetermined amount.

21. The image forming apparatus according to claim 20, comprising, a switchback conveyance unit configured to switch back the recording material on which the image is fixed by the fixing unit in such a manner that a front and a back surface of the recording material is inverted, and convey the recording material to the first conveyance unit.

* * * * *